US005749419A

United States Patent [19]

Coronado et al.

[11] Patent Number: 5,749,419

[45] Date of Patent: May 12, 1998

[54] COMPLETION APPARATUS AND METHOD

[75] Inventors: Martin P. Coronado, Cypress, Tex.; Alan Mackenzie, Muscat, Oman

[73] Assignee: Baker Hughes Incorporated, Houston, Tex.

[21] Appl. No.: 555,598

[22] Filed: Nov. 9, 1995

[51] Int. Cl.[6] ..... E21B 33/12

[52] U.S. Cl. ..... 166/387; 166/120; 166/123

[58] Field of Search ..... 166/120, 122, 166/123, 187, 387

[56] References Cited

U.S. PATENT DOCUMENTS

| | | | |
|---|---|---|---|
| 2,637,401 | 5/1953 | Ramsey | 166/187 |
| 2,781,852 | 2/1957 | Rumble | 166/187 |
| 2,831,540 | 4/1958 | Huber | 166/122 X |
| 2,942,666 | 6/1960 | True et al. | 166/187 X |
| 2,966,946 | 1/1961 | McCulloch et al. | 166/187 X |
| 2,978,029 | 4/1961 | O'Reilly et al. | 166/123 X |
| 3,374,838 | 3/1968 | Current | 166/123 |
| 3,542,128 | 11/1970 | Owen | 166/123 |
| 4,345,649 | 8/1982 | Baugh et al. | 166/120 |
| 4,796,707 | 1/1989 | Halbardier | 166/387 |
| 4,869,324 | 9/1989 | Holder | 166/387 |
| 4,928,762 | 5/1990 | Mamke | 166/192 |
| 5,271,468 | 12/1993 | Streich et al. | 166/387 |

FOREIGN PATENT DOCUMENTS

WO 93/13293 7/1993 WIPO .

*Primary Examiner*—Roger J. Schoeppel
*Attorney, Agent, or Firm*—Rosenblatt & Redano P.C.

[57] ABSTRACT

A completion apparatus and method are illustrated to allow the use of an inflatable bridge plug system to be set in lower casing after the open-hole section has been drilled under-balanced. This is coupled with an assembly to deflate the plug which is run on the bottom of the completion liner. The completion liner is run downhole without having to kill the well to reduce possible formation damage from kill fluids. Sifter the open-hole section is drilled, the plug is run in the hole on coiled tubing and set. Heavy fluids are then circulated above the plug without its being applied to the open-hole formation. The liner for the open-hole section is run in the well with a deflation tool, which ultimately engulfs the deflated plug using the mechanical support associated with the plug to facilitate the enveloping procedure. After envelopment, setdown weight releases the anchor for the plug and the assembly is run in the hole with circulation through the plug to facilitate advancement.

29 Claims, 10 Drawing Sheets

COMPLETION APPARATUS AND METHOD

FIELD OF THE INVENTION

The field of this invention relates to techniques for completions, particularly in deviated wellbores, and more particularly completions involving the use of an inflatable bridge plug for an underbalanced liner completion.

BACKGROUND OF THE INVENTION

When wells are being drilled, it is always desirable to complete the well including the bottomhole assembly liner in a manner so as to minimize the applied pressure on the formation. In essence, it is undesirable to apply excess pressure to the formation, known as killing the well, during the completion process. In prior situations, particularly those involving deviated wellbores, the initial portion of the well is drilled and a casing is set. The casing is then cemented. After the cement sets, the deviated portion of the wellbore is drilled. Prior designs have involved running a liner string into the wellbore after completion of the drilling of the deviation in the wellbore beyond the cemented casing. An inflatable packer has been inserted through the liner string to isolate the formation while the bottomhole assembly is assembled into the wellbore above an inflatable bridge plug. However, certain problems have developed in particular applications with the use of through-tubing inflatable bridge plugs. For one thing, the ability of the through-tubing inflatables to hold particular differentials can be problematic, especially if there are irregularities in the sealing surface where the plug is inflated. Additionally, due to the compact design required in certain applications, the through-tubing inflatable element cannot expand far enough to reliably hold the necessary differential pressures that may exist across the inflated bridge plug. Finally, there could also be difficulties in retrieval of the through-tubing inflatable bridge plug back through the string from which it was delivered. The flexible nature of the through-tubing inflatable design could also create problems if it was decided simply not to retrieve the plug after putting together the bottomhole assembly above it. The slender design of the through-tubing inflatable plug could create advancement problems if the plug were to be merely pushed to the bottom of the hole with the production tubing. If any washouts in the deviated portion of the wellbore are to be encountered by the bottomhole assembly with the deflated through-tubing plug at the front, then the entire assembly may get stuck prior to its being advanced to the bottom of the wellbore for proper positioning. Generally, the through-tubing designs have not provided a circulation passage therethrough to facilitate advancement of a deflated plug into the uncased portion of a wellbore using circulation.

The apparatus and method of the present invention address many of these needs by providing a downhole tool such as an inflatable bridge plug which can be set at the desired location to isolate a portion of the wellbore. The tool is securely positioned to enable it to withstand substantial differentials. After the tool is positioned, the bottomhole assembly can be put together in the wellbore with the remainder of the wellbore from the producing formation isolated. The invention accomplishes the objection of removing the plugging device or bridge plug from the path by grabbing it and deflating it. The assembly is then given additional rigidity which allows it to advance to the bottom of the hole without getting caught in washouts.

Other advantages of the apparatus and method include a physical support for the plug to facilitate its being enveloped after it is deflated by the deflation tool. The design also facilities flow through the deflation tool and through the plug as it is being advanced to the bottom of the hole.

SUMMARY OF THE INVENTION

A completion apparatus and method are illustrated to allow the use of an inflatable bridge plug system to be set in lower casing after the open-hole section has been drilled underbalanced. This is coupled with an assembly to deflate the plug which is run on the bottom of the completion liner. The completion liner is run downhole without having to kill the well to reduce possible formation damage from kill fluids. After the open-hole section is drilled, the plug is run in the hole on coiled tubing and set. Heavy fluids are then circulated above the plug without its being applied to the open-hole formation. The liner for the open-hole section is run in the well with a deflation tool, which ultimately engulfs the deflated plug using the mechanical support associated with the plug to facilitate the enveloping procedure. After envelopment, setdown weight releases the anchor for the plug and the assembly is run in the hole with circulation through the plug to facilitate advancement.

DETAILED DESCRIPTION OF THE PREFERRED EMBODIMENT

Figure 1:
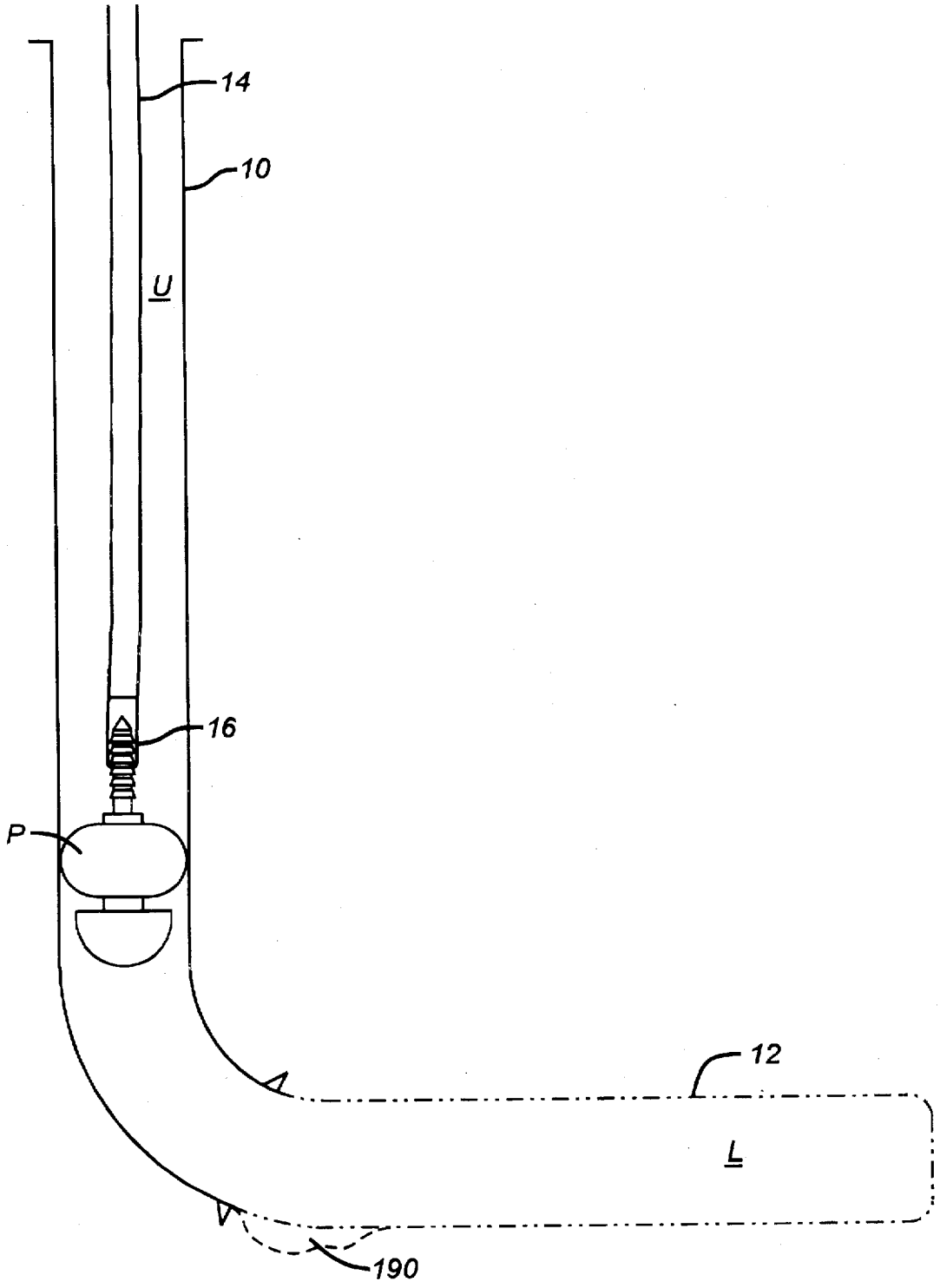
FIG. 1 illustrates a tool of the present invention set in the cased portion of the wellbore.
Figure 2:
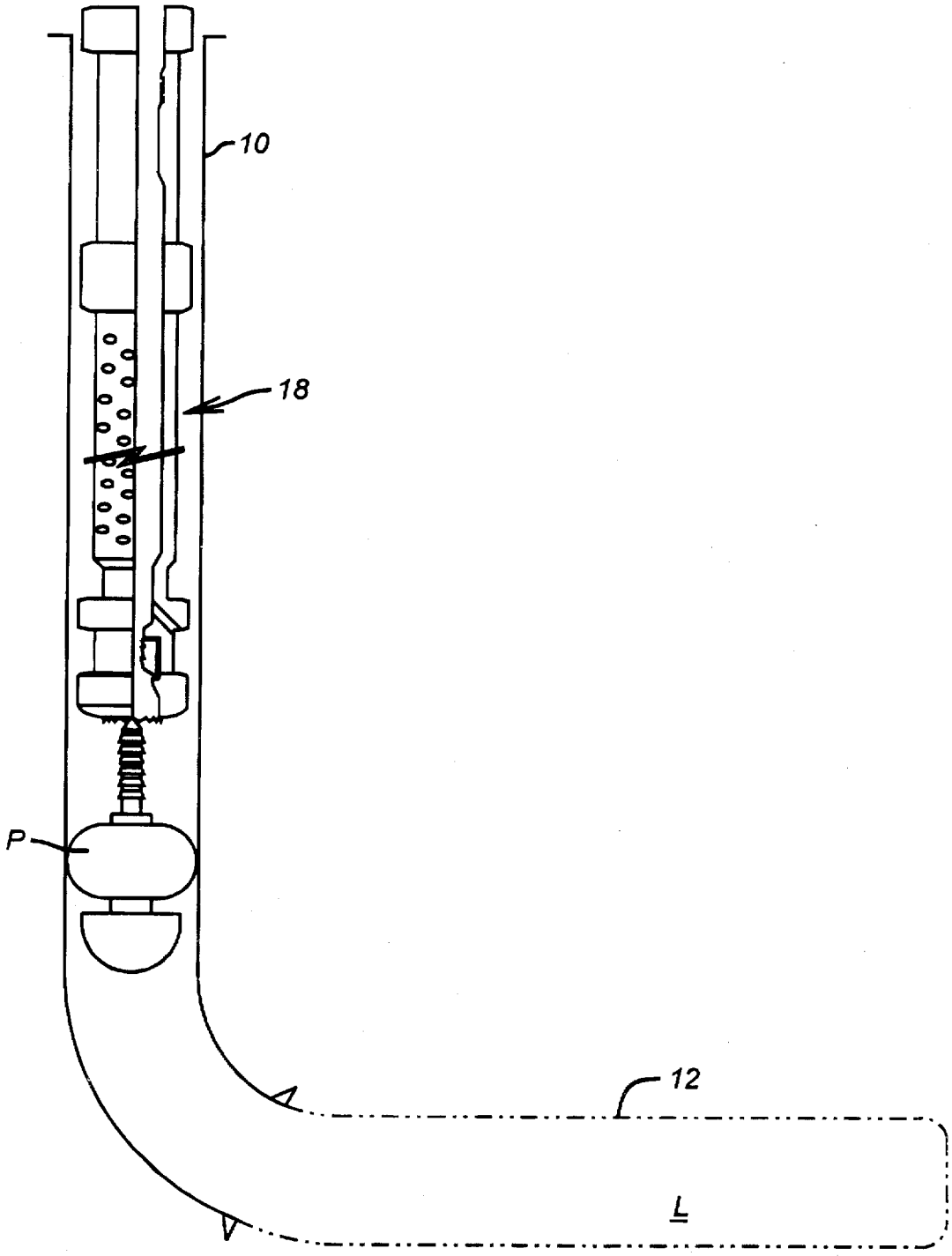
FIG. 2 is the view of FIG. 1, showing the liner assembly with the deflation tool advancing toward a tool of the present invention in the set position.
Figure 3:
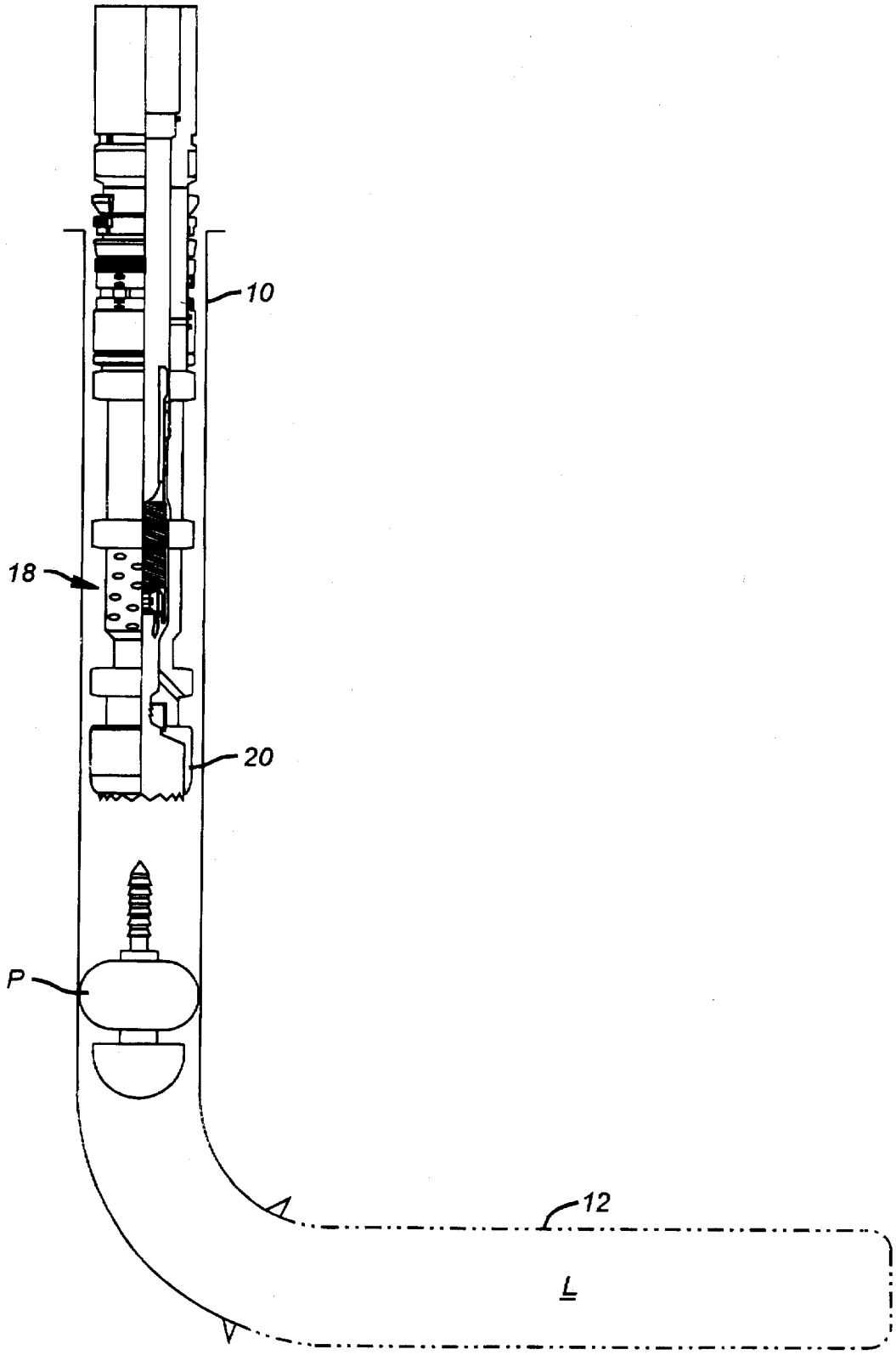
FIG. 3 is the view of FIG. 2, showing the further insertion of screens as part of the bottomhole assembly.
Figure 4:
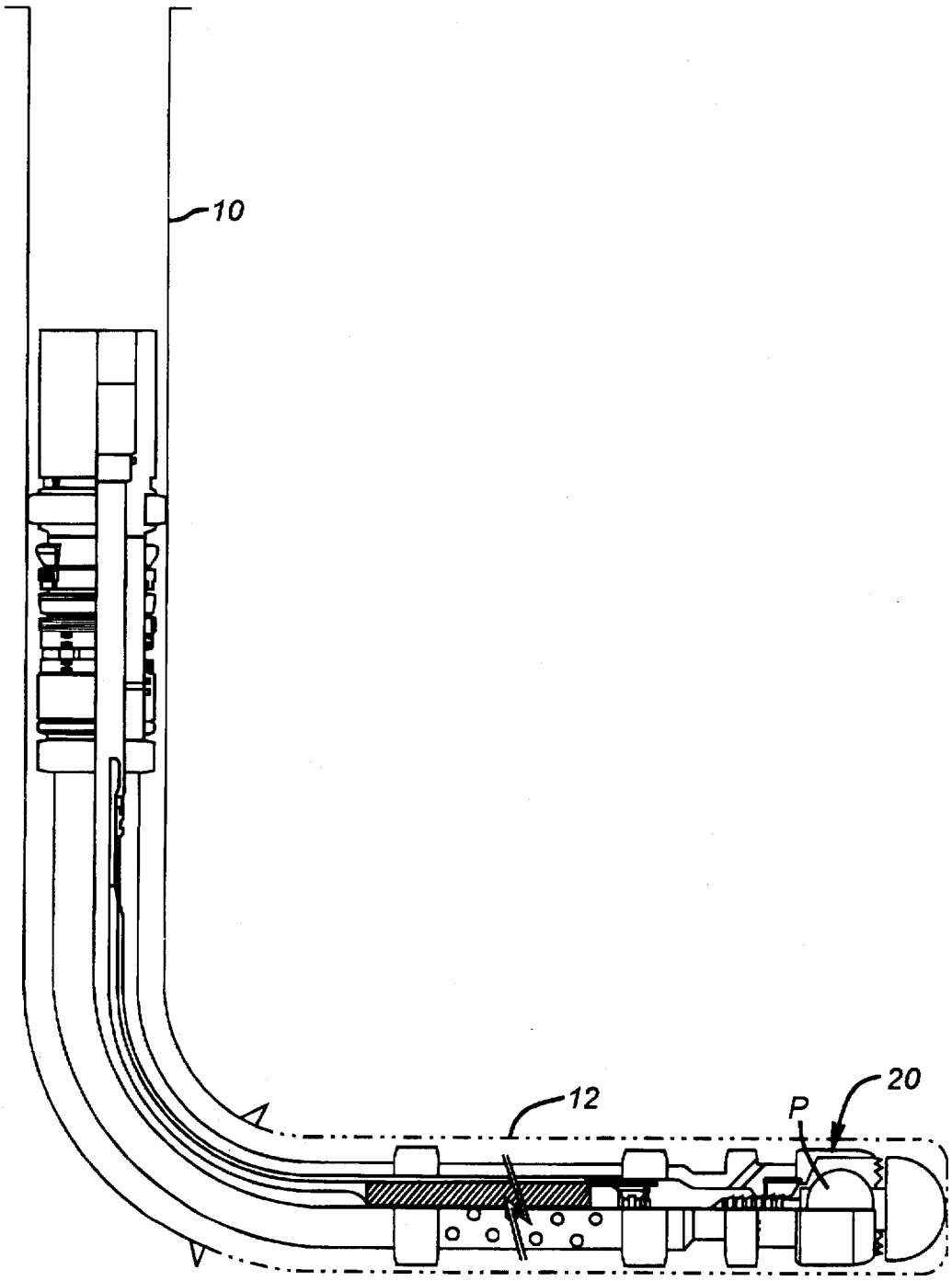
FIG. 4 shows the tool of the present invention enveloped and pushed into the bottom of the open-hole portion of the wellbore.

As seen in FIG. 1, a wellbore is depicted schematically having an upper cased section 10. The casing is cemented (not shown) prior to drilling the open hole portion 12 of the wellbore. In FIG. 1 the open hole portion 12 is shown as deviated with respect to the cased section 10. However, other configurations are also within the purview of the invention. Coiled tubing 14 with a running tool 16 at its lower end are used to insert the plug P into the cased section 10 of the wellbore. While the preferred tool is a bridge plug, other types of obstruction devices such as packers, for example, are intended to be within the scope of the invention. Upon setting the plug P, the wellbore is divided into two zones, upper zone U and lower zone L. With the plug P set, the completion liner 18 (see FIG. 2) can be run in the hole without having to kill the well. This eliminates the possibility of formation damage due to kill fluids. It should be noted that typically these types of wells have been drilled in an underbalanced state where the bottom-hole wellbore pressures are less than the formation pressure. This is a common technique, particularly with coiled tubing drilling. As shown in FIG. 2, the coiled tubing 14 has been removed and the upper wellbore U at this time can be circulated with heavy fluid wherein the pressure from that fluid is not applied to the well or portion L of the wellbore due to the presence of Plug P in an inflated condition, as shown in FIG. 1. FIG. 3 illustrates more detail of the liner assembly as well as the deflation tool 20. FIG. 4 shows the plug P in a deflated condition with the deflation tool 20 spanning over it, with the entire liner assembly advanced into the open-hole or lower portion L of the wellbore. The liner assembly attached above the deflation tool 20 does not constitute a portion of this invention and can be any one of a number of different bottomhole configurations for liners being advanced into a wellbore. It is the details of the plug P and the deflation tool 20 and how they interact to accomplish the advancement illustrated in FIG. 4 which will be described in the FIGS. 5 through 9.

FIG. 5 shows the running tool 16 along with the plug P advanced into the cased section 10 of the wellbore. The plug P has a latch mandrel 22 which is initially secured to the running tool 16 by virtue of shear pin 24 extending through piston 26. One or more collets 28 are part of the running tool 16. The piston 26 has a surface 30 which traps the collets 28 into a groove 32 in the latch mandrel 22. The running tool 16 has a ball sleeve 34 which holds open spring-loaded flapper valve 36 in the run-in position. Also shown in FIG. 5A is a ball 38 which can engage the ball sleeve 34 in the event emergency release is required as will be explained below. Normal release of the running tool 16 from the latch mandrel 22 occurs through port 40. Access to port 40 is through inlet 42 which is not blocked by ball 38 if it is to be used and landed against the ball sleeve 34. Pressure is built up in cavity 44 which is sealed by seals 46, 48 and 50. Seals 48 and 50 are on piston 26.

Figure 5A:
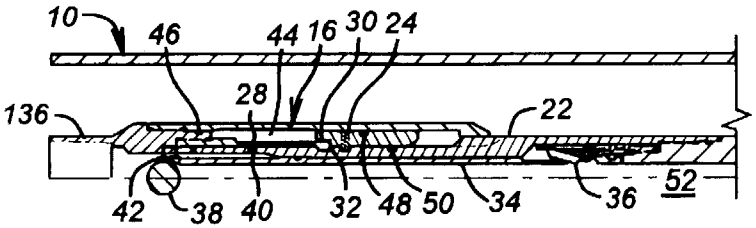
FIGS. 5A through D show the run-in position for the apparatus and method of the present invention in a sectional elevational view.
Figure 5B:
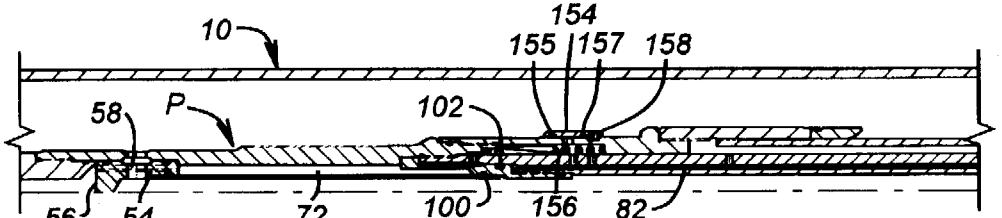
Figure 5C:
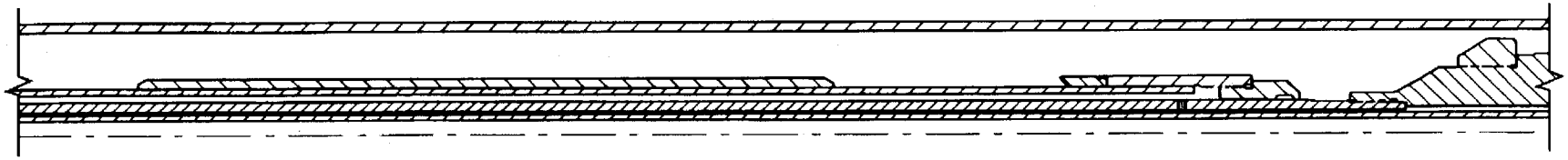
Figure 5D:
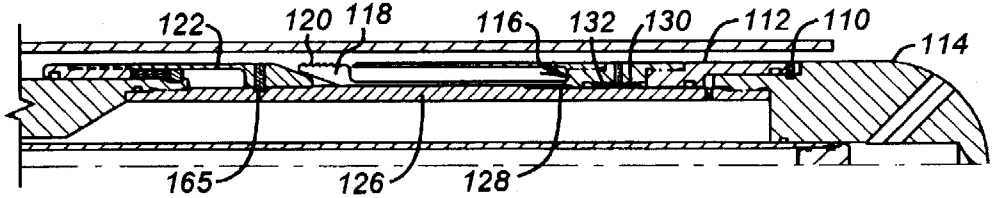
Figure 6A:
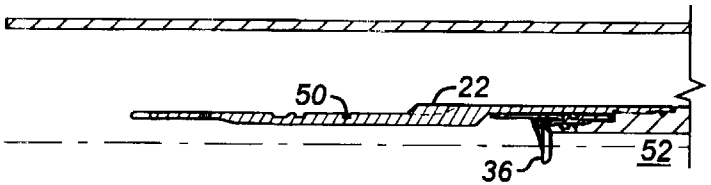
FIGS. 6A through D show the tool of FIG. 5, with the plug in the inflated position and the anchoring mechanism in a set position.
Figure 6B:
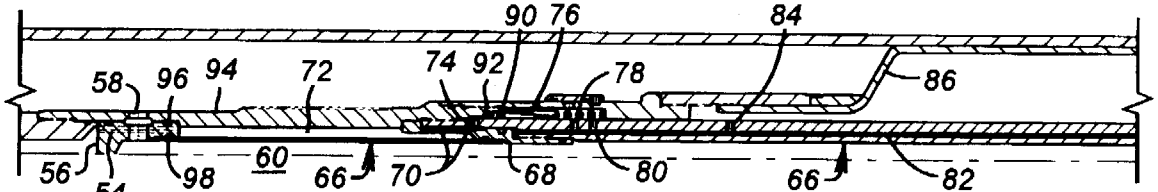
Figure 6C:
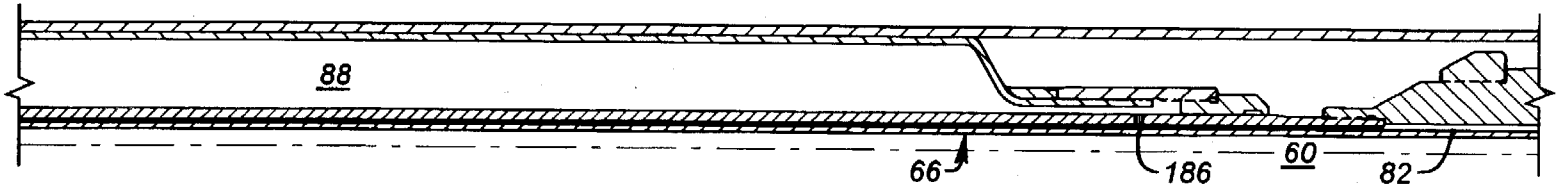
Figure 6D:
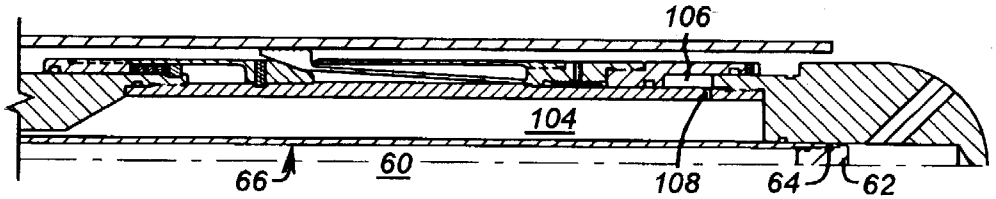

The latch mandrel 22 and the rest of the components which make up the plug P as will be described below, have a variety of flowpaths therethrough. When the assembly is run into the wellbore, as shown in FIGS. 5A through D, the next step is to inflate the plug P. This is accomplished by applying hydraulic pressure into flowpath 52. Actuation flowpath 52 communicates with passage 54. Passage 54 extends longitudinally through crossover 56. A separate circulation flowpath, which is transverse and identified as 58, provides access into the longitudinal extending portion of circulation flowpath 60 as shown in FIG. 6. Crossover 56 separates flowpaths 52 and 60. Flowpath 60 is initially obstructed, as shown in FIGS. 5 and 6D, with a plug 62 secured by shear pin 64 to inner sleeve assembly 66. The inner sleeve assembly 66 is shown to be made up of several components, one of which is a connector 68. Connector 68 has a series of transverse passages 70 which provide flow communication to annular space 72 as shown in FIG. 6B. It can now be seen that during the run-in position, shown in FIGS. 5A and B, fluid pressure without the presence of ball 38 is directed against the cross-over 56 and then through longitudinal flowpath 54 therethrough and ultimately into annular space 72, which in turn communicates with opening 70. Fluid pressure through opening 70 ultimately goes through openings 74 where a poppet 76 is pushed against a spring 78. When a predetermined pressure has been exceeded and the poppet 76 is displaced, flow can proceed through openings 80 and through annular passage 82. The poppet design is known in the art as a way to retain inflation pressure. Annular passage 82 communicates with port 84 to allow inflation of the element 86 to take place by increasing the pressure and hence the volume of cavity 88. The poppet 76 has inner and outer seals 90 and 92 which effectively prevent bypass flow around the poppet 76 until it is moved sufficiently in, compressing spring 78 in response to flow of pressure where the outer seal 92 clears out of contact with sleeve 914. Sleeve 94 is part of the outer body of plug P as shown in FIG. 6B. Sleeve 94 also has the transverse flowpath 58 extending therethrough.

It should be noted that seals 96 and 98 help separate the circulation flowpath 58 from the actuation flowpath 54 which ultimately continues into annular space 72. Seals 100 and 102 also help separate the annular flowpath 72 from annular passage 82 (see FIG. 5B).

It should be noted that as the internal pressure in passage 52 is built up, cavity 104 (see FIG. 6D), which is in fluid communication with annular passage 82, also experiences a pressure buildup. Cavity 104 communicates with cavity 106 through port 108. In the run-in position shown in FIG. 5, a shear pin 110 secures ring 112 to nose 114. Ring 112 is connected to a slip assembly 116. The slip assembly 116 includes a series of slips 118 with a rough edge 120 to get a bite into the cased portion of the wellbore 10, as shown in FIG. 6D. This is accomplished by using a cone 122 with a sloping surface 124. The nose 114 is connected to an inner sleeve 126. Sleeve 126 has a tooth pattern 128 on its outer side while the slip assembly 116 has a similar tooth pattern 130 with a different orientation. In between is a lock ring 132, which allows the slip assembly 116 to advance up or away from nose 114 responsive to a build up in pressure in cavity 106, which ultimately breaks shear pin 110. While the slips 118 are being set, the cone 122 is held to sleeve 126 by shear pin 165. Shear pin 165 is ultimately broken when it is time to release the set slips 118 to effect as will be explained below. The structure of the slips 118 and the related structure around cone 122 comprises the anchoring mechanism for the plug P. The element 86 is the sealing mechanism to isolate the upper zone U from the wear zone L as shown in FIG. 1 upon inflation.

At this point, the significant components in running and setting and releasing from the running tool 16 have been described. The sequence of events will now be reviewed to fully understand the operation of the plug P. As previously stated, coiled tubing 14 (see FIG. 1) is used to run in the plug P in combination with the running tool 16. When it is placed in the desired location in the cased wellbore 10, pressure is applied through the coiled tubing and the running tool into flowpath 52. Eventually the pressure builds up to the point where the poppet 76 is displaced against the spring 78. When that occurs, a flowpath is established from passage 54 through crossover 56 into annular space 72, through opening 70 and 74, around the poppet 76, and through the openings 80 into annular passage 82. Through the opening 84, the element 86 is inflated, against wellbore casing 10, by increasing the volume of cavity 88. Ultimately, additional pressure builds up to break the shear pin 110. At that time the slip assembly 116 advances over the cone 122 and its position is locked in via lock ring 132, as shown in FIG. 6D. Now with the element 86 set and the slips 118 secured against the cased portion of the wellbore 10, the pressure continues to build until the shear pin 24 (see FIG. 5A) breaks. When that occurs, the piston 26, which is part of the running tool 16, moves downwardly, thus making the collets 28 become unsupported. An upward pull on the coiled tubing 14, which is attached to housing 136, brings up the running tool 16, leaving behind only latch mandrel 22 which is part of the body of plug P. It should be noted that ball sleeve 34 comes out as part of the running tool assembly 16. This can be seen by comparing FIGS. 5A and 6A. As the ball sleeve 34 is pulled up, it clears the spring-loaded flapper 36, which then springs downwardly as shown in FIG. 6A. In effect, the flowpath 52 is closed when the spring-loaded flapper 36 goes into its closed position as shown in FIG. 6A. If for any reason the element 86 suffers a failure which could prevent pressure buildup to a sufficient level in flowpath 52 to allow the running tool 16 to release from the latch mandrel 22, then the ball 38 can be dropped as shown in FIG. 5A to close off flowpath 52 completely while leaving access through inlet 42 to build pressure against piston 26 for a release of the running tool 16 from the latch mandrel 22 in the manner previously described. It should also be noted that the inflated state of the element 86 is secured via spring 78, which recloses the poppet 76 when the pressure is reduced in coiled tubing 14. This occurs when the running tool 16 disengages from the latch mandrel 22. The pressure reduction seen in flowpath 52 then allows spring 78 to bias the poppet 76 back to the position shown in FIG. 6B to ensure the retention of the inflation pressure in the chamber or cavity 88.

The lock ring 132 in effect holds the slips 118 firmly against the cone 122 as shown in FIG. 6D. The plug P is now set and operations as illustrated previously in FIGS. 2 and 3 can now take place without killing the well.

Figure 7A:
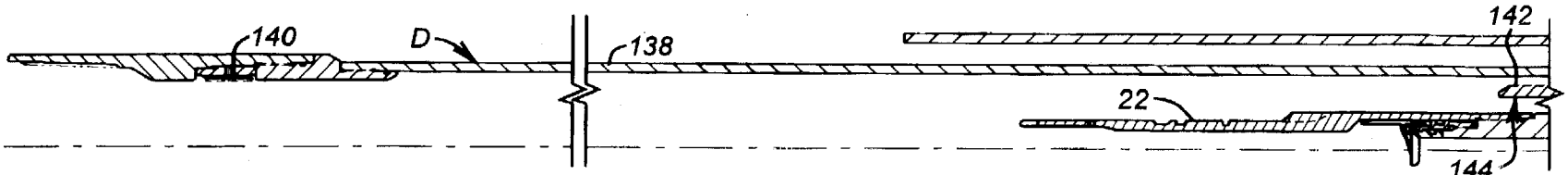
FIGS. 7A through D illustrate the insertion of the deflation tool with the inflatable element in a deflated condition and prior to release of the anchor.
Figure 7B:
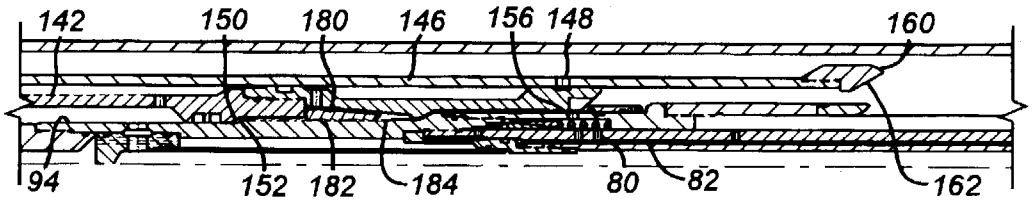
Figure 7C:
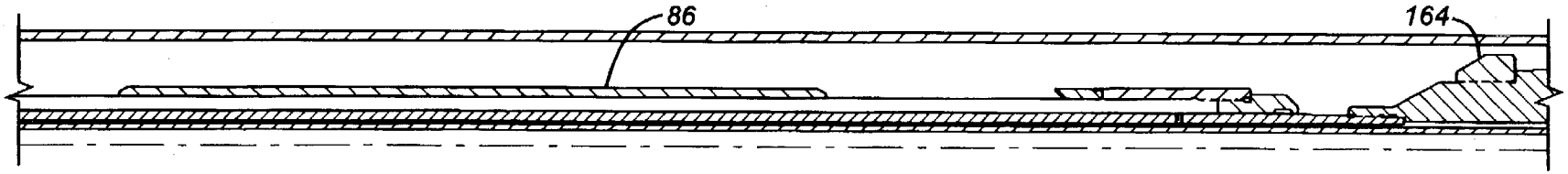
Figure 7D:
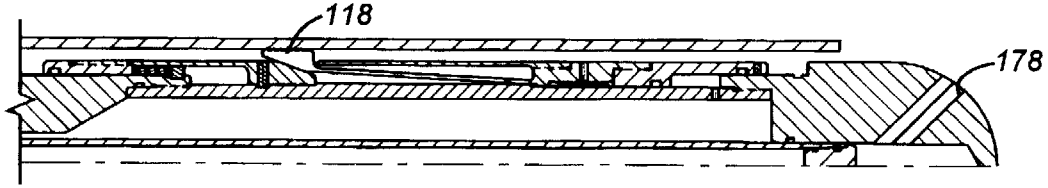

The liner assembly with the deflation tool D is run into position in the wellbore as shown in FIGS. 2 through 4. FIG. 7 illustrates the preferred deflation tool D. The bottom of a liner could also be configured to act as a deflation tool. Tool D comprises an elongated sleeve 138. Adjacent the upper end of sleeve 138 is a lock ring 140. Lock ring 140 operates on a similar principal as lock ring 132 when it, lock ring 140, ultimately engages a serrated surface 142 on upper deflation sleeve 144. Upper deflation sleeve 144 is connected to lower deflation sleeve 146, which in turn is secured to sleeve 138 of the deflation tool D by a shear pin 148 (see FIG. 7B). Upper deflation sleeve 144 has a taper 150, which ultimately engages taper 152 on sleeve 94. As the assembly of sleeve 138 with upper sleeve 144 and lower sleeve 146 is advanced over latch mandrel 22, the lower sleeve 146 eventually contacts an outer sleeve 154. Outer sleeve 154, as shown in FIG. 5B, sealingly spans over opening 156, using seals 155 and 157, and is initially held in that position by shear pin 158. When the lower deflation sleeve 146 strikes outer sleeve 154, as shown in FIG. 7B, it breaks the shear pin 158, making the sleeve 154 translate downwardly. The pressure in cavity 88, which is holding the element 86 against the cased portion of the wellbore 10, can now be vented out back through openings 84, back into annular passage 82, back through openings 80 and out through openings 156. Accordingly, FIG. 7C shows the element 86 in the deflated condition with the slips 118 still set. Lower deflation sleeve 146 now becomes trapped against sleeve 94 due to split ring 180, as will be described below. Slips 118 remain set to support the body of the plug P for the subsequent operations as will be described.

Figure 8A:
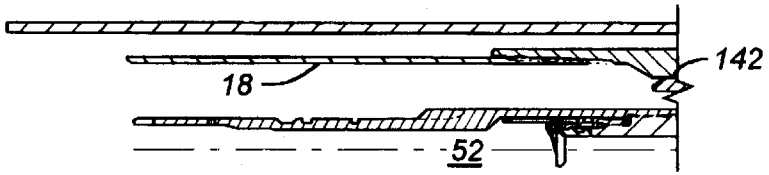
FIGS. 8A through D are the view of FIG. 7, illustrating the opening of the flowpath through the tool to allow circulation when the deflated tool is advanced toward the bottom of the open hole.

Upon securing the deflation of the element 86, the next operation is to move over the deflated element 86 with the tubularly shaped sleeve 138. To do this, weight is set down from the surface which ultimately breaks shear pin 148. When shear pin 148 breaks, the sleeve 138 can advance as shown in comparison between FIG. 7 and 8. A ring 160 sits at the bottom of sleeve 138 and has a taper 162 which ultimately bottoms on taper 164 as shown in FIG. 8C. Once the tapers 162 and 164 have made contact, weight can be applied to sleeve 126 through sleeve 138. Application of weight to sleeve 126 allows the shear pin 16 to break. When shear pin 165 breaks, spring 166 supported by ring 168 drives the cone 122 upwardly, as shown by comparing the cone position between FIGS. 8D and 9D. In FIG. 9D the spring 166 has expanded, thus pulling the cone 122 out from under the slips 118. While this is happening, a shoulder 170 on sleeve 126 contacts a shoulder 172 on slip assembly 116. Accordingly, setting down weight with tapers 162 and 164 in contact break shear pin 165, to allow spring 166 to pull the cone 122 out from under the slips 118, while at the same time downward movement of sleeve 126 brings shoulders 170 and 172 together to in effect push the slips 118 out from over the cone 122. The end result is that there is a release of the slips 118 to allow fuller progress of the liner assembly such as is illustrated in FIGS. 2 and 3, with the deflation tool D to carry the plug P forward to the bottom of the hole as shown in FIG. 4.

Figure 10:
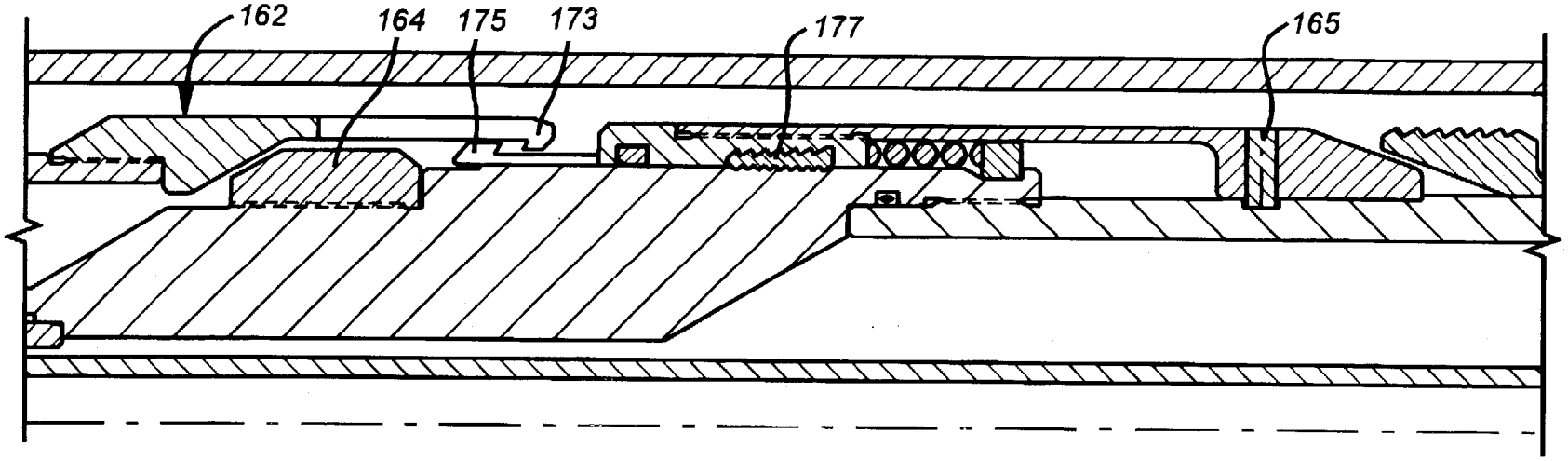
FIG. 10 is another embodiment showing release of the anchor assembly by moving the cone out from under the slip.

The deflation tool D is bottomed on a guide ring. However, slacking off weight to release the anchor may not be available due to the use of a smaller workstring (like coiled tubing) used for releasing. FIG. 10 shows the preferred arrangement for use with a coiled tubing workstring. A latch 173 on the bottom of the deflation tool 1) engages a profile 175 on the top end of the cone assembly. Applying tension to the workstring after the latching as shown in FIG. 10 will now shear the screws in the cone, releasing the anchor slip. A body lock ring 177 can be added in the cone assembly to prevent any downward movement of the cone after release. After defeating the anchor, the assembly can be run into the openhole section.

Figure 8B:
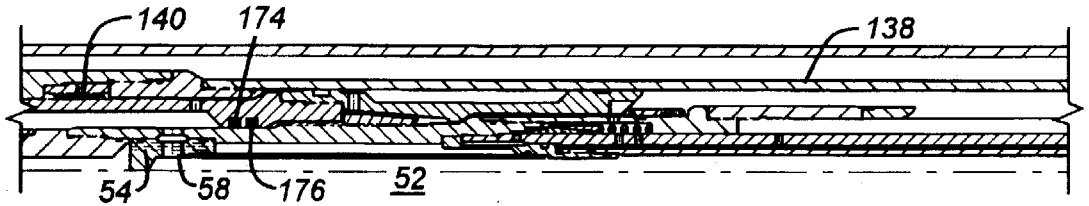
Figure 8C:
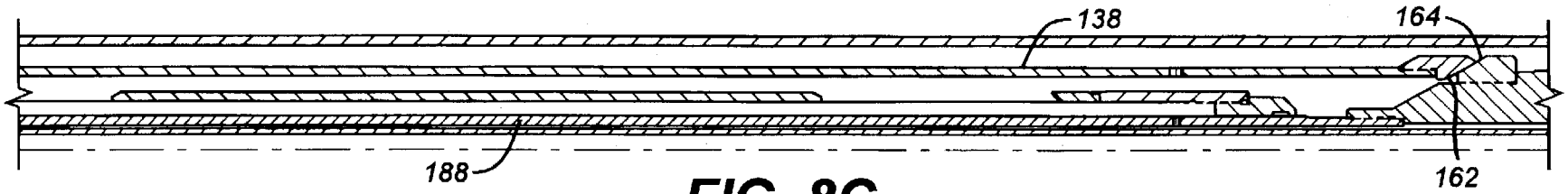
Figure 8D:
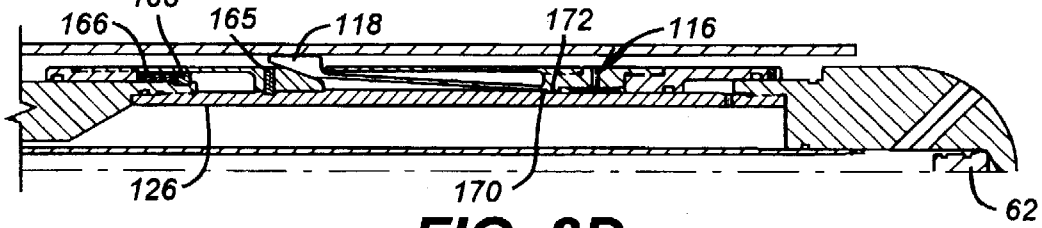
Figure 9A:
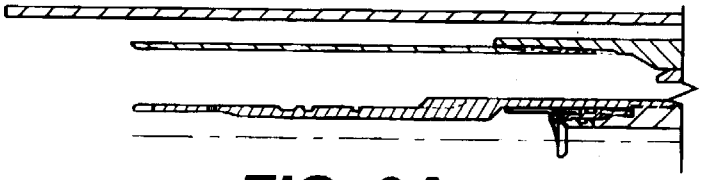
FIGS. 9A through D illustrate the release of the anchoring mechanism to allow the forward advance of the assembly with the deflation tool already having spanned over the deflated element as shown separately in FIG. 8.
Figure 9B:
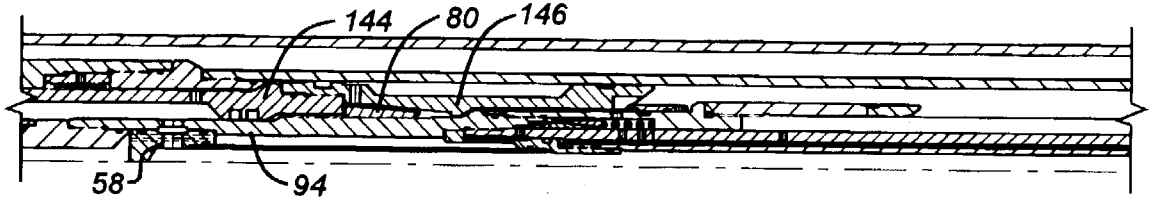
Figure 9C:
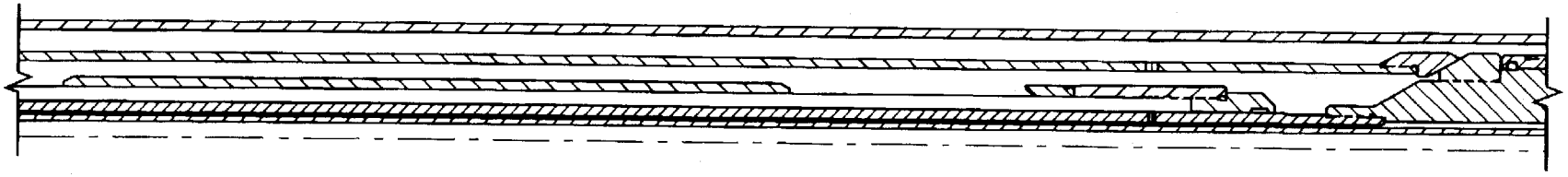
Figure 9D:
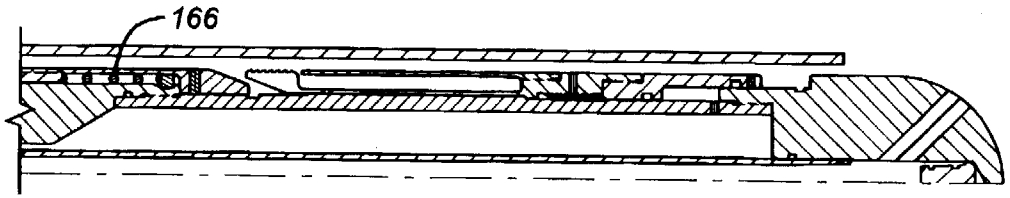

To facilitate the advancement of the liner assembly with plug P, fluid pressure is applied through[] deflation tool D, which ultimately through the flowpath 58 communicates with the plug 62 through the flowpath 60 as shown in FIG. 8B. Seals 174 and 176 facilitate the application of fluid pressure through the completion liner assembly 18 and the deflation tool D all the way down to the plug 62 which is in the nose 114. Ultimately, the shear pin 64 breaks and the plug 62 is displaced beyond openings 178, which are generally oriented laterally of the rounded nose segment 114. Thus with the displacement of the plug 62, the entire assembly can be advanced to the bottom of the uncased wellbore in the lower zone L while there is circulation through the ports 178. The rounded profile of the nose 114 also assists the nose when it is being advanced from getting snagged on any washouts in the uncased wellbore.

What has now been described is the tube or sleeve 138 advancing over the deflated element 86, with weight being set down to release the slips 118. However, prior to the release of slips 118, it is important to obtain a grip by the deflation tool D onto the body of the plug P so that when the slips 118 are released, the plug P is retained to the deflation tool D. To accomplish this a split ring 180 is supported between upper deflation ring 144 and lower deflation ring 146 as the deflation tool D is advanced. The split ring 180 which has internal teeth 182 is spread over sleeve 94, which itself has a series of jagged teeth 184. As the sleeve 138 is advanced, the split ring 180 is forced open and into and engaging contact with the sleeve 94 based on the interaction between the teeth 182 and 184. At this time the split ring 180 locks the deflation tool D to sleeve 94 because the split ring 180 cannot move up, and it thus traps the lower deflation sleeve 146. Ultimately, when the sleeve 138 of the deflation tool is advanced forward, after shear pin 148 is broken, the lock ring 140 at the top of sleeve 138 engages the serrated surface 142 on upper deflation ring 144, and the position of the sleeve 138 shown in FIG. 8 is now fully locked in. When the split ring 180 effectively locks the lower deflation sleeve 146 to the sleeve 94, the operator at the surface knows that the element 86 should have deflated due to the displacement of outer sleeve 154. At that time the weight can be set down to move the sleeve 138 over the now deflated element 86 and ultimately lock its position in with lock ring 140.

It should be noted that there is a vent port 186 toward the lower end of element 86. Vent port 186 is in fluid communication with the annual passage 82 such that when the outer sleeve 154 is pushed over, thus exposing openings 156, element 86 can deflate by venting pressure at its upper end through ports 84 as well as through the lower end through openings or ports 186. This helps to ensure that the element 86 is fully deflated with minimal trapped fluid due to elimination of pockets so that the sleeve 138 of the deflation tool D can move over element 86 smoothly without snagging it.

Split ring 180 secures the assembly of upper deflation sleeve 144 and lower deflation sleeve 146 to sleeve 94, such that when pressure is applied through flowpath 58 to displace plug 62, the deflation tool D is firmly anchored to the plug P. As previously stated, the position of the sleeve 138 when it washes over the element 86 is secured to the serrated surface 142 on upper deflation sleeve 144 as shown in FIG. 8B. With the sleeve 138 secured through the use of the lock ring 140, the overall structure gains significantly in rigidity. For example, the covering sleeve such as 138 can be made of 7" casing, while the main body 188 of the plug P can be in the order of 2⅞ which is considerably more flexible. The additional strength delivered by moving down the cover pipe 138 prevents sag in the assembly over its length. The more rigid the assembly of the completion liner 18 in combination with the deflation tool D spanning over plug P as shown in FIG. 4, the less likely is the entire assembly upon advancement to sink into washed out sections in the uncased portions of the wellbore. While FIG. 4 illustrates an ideal construction of the uncased portion of the wellbore, the reality is that there can be areas of washout in the uncased portion of the wellbore. When this occurs and it is attempted to advance the assembly as shown in FIG. 4, lack of longitudinal rigidity causes front end sag which leads its front end directly into the washed out portion. The washed out portion is illustrated as 190 in FIG. 1. It can readily be seen that if the leading end of the liner assembly is too flexible, it can easily be caught in the washout 190. To reduce this possibility, the nose 114 is rounded to help it get over or out of any small washouts. However, it is more important that the additional structural rigidity created in the assembly after the pipe or sleeve 138 is brought over the deflated element 86 ensures that the sag is kept to a minimum and thus the assembly can advance, even over a washed out segment, by merely keeping true to its line of travel without sagging into washouts in the uncased portions of the wellbore. The structure is akin to a cantilevered beam which can sag at its free end if it is not sufficiently rigid.

The assembly of the slips 118 as previously described provides additional support for the plug P when the element 86 is inflated. Additionally, it provides continuing support for the body of plug P when the element 86 is deflated. This additional continuing support after deflation helps to make it possible to advance the sleeve 138 over the deflated element 86 to increase the longitudinal rigidity and thus minimizing sag, in the assembly upon subsequent advancement. The design also features a flowpath all the way to the nose 114 through outlets 178 so that circulation can be maintained while the assemblies advance as shown in FIG. 4. Circulation while advancing facilitates the advancement of the assembly to the position shown in FIG. 4.

Proper deflation of the element 86 is more likely in view of the vent ports 84 and 186, respectively, at the upper and lower ends of cavity 88. With the deflation occurring through ports 84 and 186, the likelihood of trapped fluid within the cavity 88 when outer sleeve 154 is displaced is greatly reduced. That means the sleeve 138 can then more dependably go over the deflated element 86 at a time when the element is fully deflated and will not stand in the way or impede the progress of the advancing sleeve 138.

The spring-loaded flapper 36 covers over passage 52 after removal of the running tool 16. In that position pressure directed through the completion liner assembly 18, when fully latched to the plug P as shown in FIGS. 8A and B, will force any pressure through flowpath 58 for initially breaking loose plug 62, thus clearing the flowpath 178 and nose 114. With the spring-loaded valve 36 in the closed position, passage 54 is closed off so that applied pressure within the completion liner assembly 18 cannot communicate with flowpath 52 or passage 54.

When the completion liner assembly 18 is advanced to the position shown in FIG. 4, production in the known manner can begin from the uncased portion of the wellbore.

It should be noted that while the preferred embodiment comprises a sleeve 138 coming over the plug P, stiffening the plug or other downhole tool in other ways is a part of the invention. The sleeve 138 can be of differing construction and can cover all or part of plug P. Plug P can be stiffened after deflation by adding rigidity to its body, internally as opposed to externally, using sleeve 138 or by other equivalent techniques.

The foregoing disclosure and description of the invention are illustrative and explanatory thereof, and various changes in the size, shape and materials, as well as in the details of the illustrated construction, may be made without departing from the spirit of the invention.

We claim:

1. A method of completing a wellbore, comprising:

running in a plug having an inflatable element and a separate anchoring mechanism;

isolating a lower zone in a wellbore by inflating said element and releasably locking with a locking device said anchoring mechanism in a set position;

deflating said element with a subsequently installed deflation tool;

continuing support for said plug with said locked anchoring mechanism after said deflation until a predetermined release force is exerted which is sufficient to overcome said locking device.

2. A downhole tool assembly for a well, comprising:

a body;

a sealing element on said body for selectively sealing off the well;

an anchoring assembly on said body;

said body configured to allow selective release of said sealing element while leaving said anchoring assembly in an engaged position where it still supports said body in the wellbore;

said sealing element is actuated by fluid pressure which causes said sealing element to flex to seal off the well; and a deflation tool insertable in the well and contacting said body to initially deflate said element and then to advance over at least a portion of said deflated element while said body is supported in the well by said anchoring assembly.

3. The assembly of claim 2, wherein:

a portion of said deflation tool secures itself to said body while an outer sleeve on said deflation tool advances over said element until said element is covered and further movement of said outer sleeve is stopped by said body.

4. The assembly of claim 3, wherein:

said outer sleeve, when advanced into contact adjacent a lower end thereof with said body, transmitting an applied force to said body to defeat said anchoring assembly.

5. The assembly of claim 4, wherein:

said outer sleeve is secured to said body after it advances over said element.

6. The assembly of claim 2, wherein:

said body formed having a circulation flowpath therethrough, extending to a lower end thereof;

said flowpath initially obstructed;

said deflation tool, upon engagement with said body, facilitating clearing of said flowpath for flow therethrough.

7. The assembly of claim 5, wherein:

said body is formed with an internal actuation flowpath in fluid communication with said anchoring assembly and said sealing element for sequential setting of said element followed by actuation of said anchoring assembly.

8. The assembly of claim 7, wherein:

said actuation flowpath further comprising a vent port covered by a vent sleeve;

said deflation tool when advanced over said body moves said vent sleeve to deflate said element.

9. The assembly of claim 8, wherein:

said deflation tool comprises an internal assembly which, upon displacing said vent sleeve, attaches to said body;

whereupon said outer sleeve on said deflation tool comes free of said internal assembly to advance over said now-deflated element.

10. The assembly of claim 9, wherein:

said deflation tool covers at least a portion of said body in a sealing relation upon contact of said internal assembly to said body;

said body formed having a circulation flowpath therethrough, extending to a lower end thereof;

said circulation flowpath is formed having a transverse opening through said body whereupon subsequent flow through said deflation tool is directed through said transverse opening to the lower end of said body through said circulation flowpath.

11. The assembly of claim 10, wherein:

said body is run into the well with a running tool;

said running tool holding open a valve in flow communication with an inlet to said internal actuation flowpath;

said valve closing upon release of said running tool;

whereupon application of pressure through said deflation tool when sealingly engaged to said body, said closed valve isolates said internal actuation flowpath.

12. The assembly of claim 11, wherein said anchoring assembly further comprises:

at least one slip hydraulically actuable from said internal actuation flowpath to move with respect to said body over a cone to an outward position where it is locked to support said body;

said cone initially secured to said body;

a biasing member on said body to bias said cone out from under said slip upon its release from said secured position to said body;

said outer sleeve of said deflation tool transferring a setdown weight to said slip to push it away from said cone for a release of said body from support by the wellbore.

13. The assembly of claim 7, wherein:

said sealing element is in fluid communication with said internal actuation flowpath at a point near its lower end and another point near its upper end for facilitation of deflation prior to advancement of said deflation tool over said sealing element.

14. The assembly of claim 4, wherein:

said body has a rounded lower end to facilitate its advancement by said deflation tool over washouts in the wellbore upon release of said anchoring assembly.

15. The assembly of claim 6, wherein:

a portion of said deflation tool secures itself to said body while an outer sleeve on said deflation tool advances over said element until said element is covered and further movement of said outer sleeve is stopped by said body.

16. The assembly of claim 15, wherein:

said outer sleeve, when advanced into contact adjacent a lower end thereof with said body, transmitting an applied force to said body to defeat said anchoring assembly.

17. The assembly of claim 16, wherein:

said outer sleeve is secured to said body after it advances over said element.

18. The assembly of claim 17, wherein:

said body is formed with an internal actuation flowpath in fluid communication with said anchoring assembly and said sealing element for sequential setting of said element followed by actuation of said anchoring assembly.

19. The assembly of claim 18, wherein:

said actuation flowpath further comprising a vent port covered by a vent sleeve;

said deflation tool when advanced over said body moves said vent sleeve to deflate said element.

20. The assembly of claim 19, wherein:

said deflation tool comprises an internal assembly which, upon displacing said vent sleeve, attaches to said body;

whereupon said outer sleeve on said deflation tool comes free of said internal assembly to advance over said now-deflated element.

21. The assembly of claim 20, wherein:

said deflation tool covers at least a portion of said body in a sealing relation upon contact of said internal assembly to said body;

said circulation flowpath is formed having a transverse opening through said body whereupon subsequent flow through said deflation tool is directed through said transverse opening to the lower end of said body through said circulation flowpath.

22. A method of completing a wellbore, comprising:

running in a plug having an inflatable element and a separate anchoring mechanism;

isolating a lower zone in a wellbore by inflating said element and setting said anchoring mechanism;

deflating said element with a subsequently installed body;

continuing support for said plug with said anchoring mechanism after said deflation;

using a deflation tool as said subsequently installed body;

covering over at least in part said deflated element with advancement of said deflating tool.

23. The method of claim 22, further comprising:

latching said deflating tool to the body of said plug;

using said latched deflating tool to release the anchoring mechanism.

24. The method of claim 23, further comprising:

providing on said deflation tool an outer sleeve and an inner assembly;

providing a fluid actuation passage in said body;

using said inner assembly to create an opening in said fluid actuation passage for deflation of said element;

latching said inner assembly to said body;

moving said outer sleeve of said deflation tool over said deflated element until said outer sleeve bottoms on said body.

25. The method of claim 24, further comprising:

latching said outer sleeve of said deflation tool to said body when it bottoms against it;

setting down weight on said bottomed sleeve to release said anchoring mechanism.

26. The method of claim 23, further comprising:

providing a circulation flowpath extending to the lower end of said body;

providing fluid communication from said deflation tool, when latched to said body, to said circulation flowpath;

circulating fluid through said circulation flowpath to the lower end of said body as said body is advanced further into the wellbore.

27. The method of claim 26, further comprising:

providing a fluid actuation passage in said body;

holding said fluid actuation passage open with a running tool attached to said body;

sequentially inflating said element and setting said anchoring mechanism with fluid pressure;

releasing said running tool due to pressure build-up to a predetermined valve in said body;

closing a valve in said body as a result of removal of said running tool;

blocking internal access to said fluid actuation passage by said valve closing.

28. The method of claim 27, further comprising:

holding open said valve with a sleeve having a ball seat;

dropping a ball onto said ball seat to close off said fluid actuation passage in the event of failure of said element to hold pressure;

obtaining emergency release of said body from said running tool by applying pressure against said seated ball.

29. The method of claim 26, further comprising:

initially blocking said fluid circulation flowpath while running in;

clearing said fluid circulation flowpath with applied pressure from said deflation tool.

* * * * *